US005507681A

United States Patent [19]

Smith et al.

[11] Patent Number: 5,507,681

[45] Date of Patent: Apr. 16, 1996

[54] CUSHION STRAP ASSEMBLY AND METHOD OF MAKING SAME

[75] Inventors: Eugene A. Smith, Sharpsburg, Ga.; Donald J. LaTorre, Staten Island, N.Y.; Shantilal G. Patel, Clifton; Anthony J. Tedeschi, Ridgewood, both of N.J.

[73] Assignee: Playtex Apparel, Inc., Stamford, Conn.

[21] Appl. No.: 162,537

[22] Filed: Dec. 3, 1993

[51] Int. Cl.[6] ..... A41B 3/12; A41D 27/00; A41D 27/26

[52] U.S. Cl. ..... 450/86; 450/92; 450/93; 2/267; 2/268; 2/243.1

[58] Field of Search ..... 2/267, 268, 243.1, 2/22, 23, 24, 16, 2, 162, 167, 170, 169, DIG. 11, 171; 450/39, 40, 92, 93, 86

[56] References Cited

U.S. PATENT DOCUMENTS

| | | | |
|---|---|---|---|
| 2,402,292 | 6/1946 | Nichols | 2/268 |
| 2,485,720 | 10/1949 | Elliot et al. | 2/336 |
| 2,511,483 | 6/1950 | Skirow et al. | 2/268 |
| 2,523,720 | 9/1950 | Riedler et al. | 2/268 |
| 2,616,093 | 11/1952 | Talalay | 2/268 |
| 2,646,573 | 7/1953 | Morgenstern | 2/268 |
| 2,802,216 | 8/1957 | Vogel | 2/268 |
| 3,025,859 | 3/1962 | Rosenberg | 128/510 |
| 3,121,878 | 2/1964 | Wilder et al. | 2/268 |
| 3,256,131 | 6/1966 | Kock et al. | 161/119 |
| 3,369,547 | 2/1968 | Sack et al. | 128/296 |
| 3,616,148 | 10/1971 | Edelman | 161/89 |
| 4,100,924 | 7/1978 | Rosenberg | 128/510 |
| 4,332,633 | 6/1982 | Yamauchi et al. | 156/62.2 |
| 4,612,935 | 9/1986 | Greifer | 128/510 |
| 4,638,513 | 1/1987 | Woods | 2/268 |
| 4,795,399 | 1/1989 | Davis | 450/86 |
| 4,795,400 | 1/1989 | Greenberg | 450/86 |
| 4,845,785 | 7/1989 | Allen | 2/268 |
| 4,894,868 | 1/1990 | Christopher | 2/268 |
| 4,945,576 | 8/1990 | Melton | 2/268 |
| 4,963,208 | 10/1990 | Muncy et al. | 156/145 |
| 5,155,869 | 10/1992 | Ralli et al. | 450/86 X |
| 5,165,113 | 11/1992 | Hyams et al. | 2/268 |
| 5,240,538 | 8/1993 | Hyams et al. | 156/245 |

FOREIGN PATENT DOCUMENTS

| | | | |
|---|---|---|---|
| 2027976A | 2/1987 | Japan | A63B 71/12 |

*Primary Examiner*—Jeanette E. Chapman
*Attorney, Agent, or Firm*—Ohlandt, Greeley, Ruggiero & Perle

[57] ABSTRACT

A cushion strap assembly and method of making same is provided which cushion strap assembly is adapted to be used in a brassiere shoulder strap. The assembly includes a top fabric layer, a first adhesive web layer positioned on one side of the top fabric layer, and a base layer positioned on the first adhesive layer on the side opposite that of the top fabric layer. The assembly also includes a cushion filler that is a first cushion layer, a third adhesive web layer positioned on a side of the first cushion layer, a second cushion layer positioned on the third adhesive layer on the side opposite that of the first cushion layer. A second adhesive web layer can be part of the cushion filler or separate. In either event, it is positioned on the first cushion layer on the side opposite the third adhesive web layer. The assembly further includes a fourth adhesive web layer positioned on the second cushion layer on the side opposite that of the third adhesive web layer, and a bottom fabric layer positioned on the fourth adhesive web layer on the side opposite that of the second cushion layer.

24 Claims, 4 Drawing Sheets

CUSHION STRAP ASSEMBLY AND METHOD OF MAKING SAME

BACKGROUND OF THE INVENTION

1. Field of the Invention

The present invention relates generally to a strap assembly and, more particularly, to a cushion strap assembly for use in a shoulder strap. This cushion strap assembly provides relief from the normal discomfort associated with shoulder straps, while maintaining the desired aesthetic appearance even after repeated machine washings. In addition, the present invention provides a method of making such a cushion strap assembly. A primary use of this cushion strap assembly is in shoulder straps of a brassiere.

A well known problem associated brassiere shoulder straps is the discomfort caused by the strap on the shoulder of the wearer. Specifically, each brassiere strap will normally cause either a depression or irritation in the shoulder and may even interfere with arterial or venous drainage. Numerous attempts have been made to relieve this discomfort. Some attempts have included use of shoulder pads of cotton or foam rubber that are interposed between the strap and the wearer's shoulder or releasably attachable to the strap.

Significantly, such pads have proven to be bulky and unsightly. Also, there are inconveniences attendant with such attachments since such pads will need to be removed, and subsequently reattached, each time the brassiere is washed.

Some brassiere straps have attempted to incorporate a pad structure in the strap itself. Such brassiere straps may have achieved a modicum of success in relieving discomfort. Moreover, such brassieres have limited user life since they fail to maintain their desired appearance after several machine washings apparently due to the affect cleaning detergents have on the construction and materials of the brassiere strap. Particularly well known is that pads and straps made of foam have been found to yellow after a few washings. It is also common that brassieres that have incorporated a pad therein have a knotted or bumpy appearance after repeated machine washings.

Other attempts to relieve discomfort, yet provide a modicum of pleasing appearance, have included widening the shoulder strap in order to better distribute the weight in the shoulder area. Still other attempts have been to incorporate elastic bands with a padded cover in the strap to provide more flexibility and thus attempt to better distribute the pressure in the shoulder area.

All such attempts have, heretofore, failed to achieve the desired results, namely relief of the discomfort in the shoulder area, with a smooth attractive appearance that is maintained even after repeated wear and machine washing. Thus, long wear life and comfort have evaded prior art shoulder straps.

2. Description of the Prior Art

A number of prior art patents illustrate the use of a pad that is secured to a shoulder strap. For example, U.S. Pat. No. 4,845,785 to F. Allen, titled: Hinged Shoulder Pad, is directed to a shoulder pad that has a laminated unitary structure arrangement comprising a plurality of juxtaposed panels overlying one another, and hinge means integrally connecting adjacent panels to enable relative flexible pivotal movement therebetween.

U.S. Pat. No. 4,795,399 to W. W. Davis, titled: Brassiere Shoulder Strap Bearing Pad, is directed to a bearing pad for brassiere shoulder straps that is intended to alleviate irritating indentations to the skin of the wearer. The pad comprises a composite elongated member having two plies of material fastened together, one of said plies defining an upper ply adapted to engage one of the shoulder straps to act as a bearing surface, and the other ply defining a lower ply for contacting the skin of the wearer. The upper ply is a stiff, high density, polyethylene synthetic plastic material, and the lower ply is a low density, soft, non-woven cushion material comprising polyester fibers. The upper ply has attaching means that entrap the brassiere strap while permitting the pad to adjustably slide along the strap for positioning on the shoulder of the wearer.

U.S. Pat. No. 2,523,720 to W. Riedler, et al., titled: Shoulder Pad, provides a cover having superposed thereon plies that are placed one upon another. The plies are preferably formed of a relatively loose mass of fibers, the surface of which are coated with a thermosetting plastic and adhesive. See also, U.S. Pat. No. 2,485,720 to G. B. Elliott, et al., titled: Pad For Shoulder Straps, that provides a shoulder pad having an upper fabric layer adhesively secured to a lower fabric layer, and U.S. Pat. No. 2,511,483 to B. Skirow, et al., titled: Shoulder Pad For Garments And The Like, that includes a plurality of superimposed layers of loosely felted fibrous material, and U.S. Pat. No. 2,616,093 to J. A. Talalay, titled: Apparel Pad, that shows a plurality of layers of woven fabric separated apart by layers of rubber. Also, U.S. Pat. No. 3,369,547 to G. H. Sack, et al., titled: Extensible Sheet Material, that provides an intermediate layer of non-elastic fibers containing between a top covering layer and a bottom covering layer of polyurethane sponge that are bonded together by a continuous heat seal along the edges, and U.S. Pat. No. 3,121,878 to J. J. Wilder, et al.

U.S. Pat. No. 4,945,576 to A. R. Melton, titled: Shoulder Pad and Brassiere Strap Cushion Apparatus, is directed to a shoulder pad and strap cushion that includes an outer layer, an inner layer, cushion means disposed between the outer and inner layers, and fastening means secured to the inner layer means for securing the bra strap between the inner and outer layer means of the pad.

Other prior art patents provide for the padded material as an insert or an integral part of the brassiere shoulder strap. For example, U.S. Pat. No. 2,402,292 to B. Nichols, titled: Shoulder Pad, discloses a pad or bat of soft material that gives the shoulder pad substantial thickness. The bat is held in place by the arrangement of an upper fabric layer and a lower fabric layer that form a pocket. In addition, the pad is substantially wider at the mid-portion than at the area at which the straps are connected.

U.S. Pat. No. 4,100,924 to F. M. Rosenberg, titled: Shoulder Strap, is directed to a shoulder strap that includes a flexible elongated main strap portion, a widened flexible intermediate portion, a first single pocket extending diagonally to the length of the strap across the intermediate portion, a second single pocket having a width less than the width of the first pocket and extending at an angle with respect to the length of the strap across the intermediate portion, and a pair of stays each disposed within a pocket. The stays substantially bridge the scapula and clavicle of the person's shoulder without interfering with arterial or venous drainage of the shoulder.

U.S. Pat. No. 3,025,859 to F. M. Rosenberg, titled: Shoulder Load Carrying Strap, provides a strap that comprises a relatively wide intermediate supporting portion that is integrally connected to the respective shoulder strap elements. The strap comprises a flexible outer fabric layer and a relatively soft yieldable cushioning material or flexible inner layer that is adapted to engage the wearer's body.

Still other prior art patents includes an elastic member, or form a laminate that include a padded material. For example, U.S. Pat. No. 4,638,513 to A. J. Woods, titled: Laterally Stabilized Bra Strap, is directed to a strap that has elastic ribbon means adapted to stretch in at least the longitudinal direction, padding means enclosing the elastic ribbon means, smooth-faced material means enclosing the padding means, and stitching means attaching the ribbon means, the padding means, and the material means along each longitudinal edge of the strap.

U.S. Pat. No. 4,795,400 to B. Greenberg, titled: Brassiere Strap, provides a brassiere strap that includes a laminate band consisting of a foam laminate located between an outer laminae, an inner laminae formed of at least a ply of fabric, and first and second cold adhesive layers sealing the foam laminae to the outer and inner laminaes. The combined laminate and elastic bands provide sufficient rigidity to prevent substantial bowing in response to longitudinal stresses in the brassiere strap, yet sufficient flexibility to permit the strap to conform to the configuration of the shoulder of the brassiere.

U.S. Pat. No. 3,616,148 to I. Edelman, titled: Laminated Shoulder Strap, is laminated from a nylon tricot fabric tape, a cotton fabric tape, and a thermoplastic web formed of a material capable of bonding together tapes. See also U.S. Pat. No. 3,256,131 to A. G. Koch, et al., titled: Embossed Laminate And Method Of Making Same, provides a cover material placed over foam that in turn is placed over backing material, such as nylon fabric, to form a laminate; and Japanese reference '976 provides a core material of urethane foam, adhesive and a cover, that are heated and pressed together.

U.S. Pat. No. 5,165,113 to A. Hyams, et al., titled: Padded Straps For Garments and Method of Making Same, is directed to a padded strap for a garment that includes a core of resilient material having a pad portion of a first thickness and density, and a compressed base portion surrounding the pad portion of a second lesser thickness and second greater density, and tab portions that provide means for securing the strap to a garment formed from a part of the compressed portion. The core is, preferably, an ester-polyurethane foam, although apparently fiberfill can be used. Also, U.S. Pat. No. 5,240,538 to A. Hyams, et al., titled: Method For Making Padded Straps For Garments, which is a division of the application that resulted into the above patent, is directed to a method of making the padded strap of the above patent.

Other attempts to distribute pressure and therefore ease discomfort include U.S. Pat. No. 4,894,868 to P. E. Christopher, titled: Shoulder Pad Harness, that provides an adjustable narrow band, first and second shoulder straps and first and second shoulder pads, and U.S. Pat. No. 4,612,935 to C. R. Greifer, titled: Comfort Accessories For Brassieres, that is directed to strap adjusting means.

U.S. Pat. No. 4,332,633 to K. Yamauchi, et al., titled: Method For Producing A Shoulder Pad Material, is directed to a method of producing a shoulder pad blank having a thick walled portion and a thin walled portion. It specifically provides for cutting a sheet of shoulder pad stock material sinusoidally into two intermediate blanks each having a plurality of ridges, as well as other features. This patent provides for high production yields by minimizing wasted stock.

Thus, all of these patents fail to provide the strap construction of the present cushion strap assembly. They also appear to fail to use the materials that in conjunction with this construction, achieve comfort and long wear life coupled with a good appearance.

SUMMARY OF THE INVENTION

Against the foregoing background, it is a primary object of the present invention to provide a cushion strap assembly for a shoulder Strap that alleviates discomfort and irritation.

It is another object of the present invention to provide such a cushion strap assembly and resultant shoulder strap that have an attractive, non-bulky outer appearance.

It is still another object of the present invention to provide such a cushion strap assembly and resultant shoulder strap that are free of wrinkles and bunching even after extended use and repeated washings.

It is yet another object of the present invention to provide such a cushion strap assembly that is made of materials and constructed to achieve long wear life.

It is a further object of the present invention to provide such a cushion strap assembly that will be used in the shoulder straps of a brassiere.

It is a still further object of the present invention to provide a method of making such a cushion strap assembly.

To the accomplishments of the foregoing objects and advantages, the present invention, in brief summary, comprises a laminated cushion strap assembly. The assembly includes: a top cover having a top fabric layer, a first adhesive web layer positioned on one side of the top fabric layer and a base layer positioned on the first adhesive layer on a side opposite that of the top fabric layer; a bottom fabric layer that forms with the top cover an enclosure; and, a cushion filler adapted to be secured in the enclosure. The cushion filler comprises a first cushion layer, a third adhesive web layer positioned on the first cushion layer, and a second cushion layer positioned on the third adhesive web layer on a side opposite that of the first cushion layer. The laminated cushion strap assembly also includes a second adhesive web layer positioned between the base layer and the first cushion layer on the first adhesive web layer to secure the cushion filler to the top cover. In one embodiment, the second adhesive web layer is a component of the cushion filler. The laminated cushion strap assembly further includes a fourth adhesive web layer positioned on the second cushion layer on a side opposite that of the third adhesive layer to secure the bottom fabric layer to the cushion filler.

The present invention also provides a method of making this cushion strap. The method includes: laminating a top cover having a top fabric layer, a first adhesive web layer positioned on one side of the top fabric layer and a base layer positioned on the first adhesive web layer on the side opposite that of the top fabric layer, to form a binder layer; and positioning a cushion filler on the binder layer. The cushion filler has a second adhesive web layer, a first cushion layer positioned on a side of the second adhesive web layer, a third adhesive web layer positioned on the first cushion layer on the side opposite the second adhesive web layer, and a second cushion layer positioned on the third adhesive web layer on the side opposite that of the first cushion layer. All such layers are positioned on each other and on the binder layer. The method further includes positioning, on the side opposite that of the third adhesive layer, a fourth adhesive web layer on the second cushion layer of the cushion filler; positioning a bottom fabric layer on the fourth adhesive web layer on the side opposite that of the second cushion layer; and laminating together the binder layer, the cushion filler and the bottom fabric layer to form the cushion strap assembly.

BRIEF DESCRIPTION OF THE DRAWINGS

The foregoing and still other objects and advantages of the present invention will be more apparent from the following detailed explanation of the preferred embodiments of the present invention in connection with the accompanying drawings wherein.

BRIEF DESCRIPTION OF THE PREFERRED EMBODIMENTS

Figure 1:
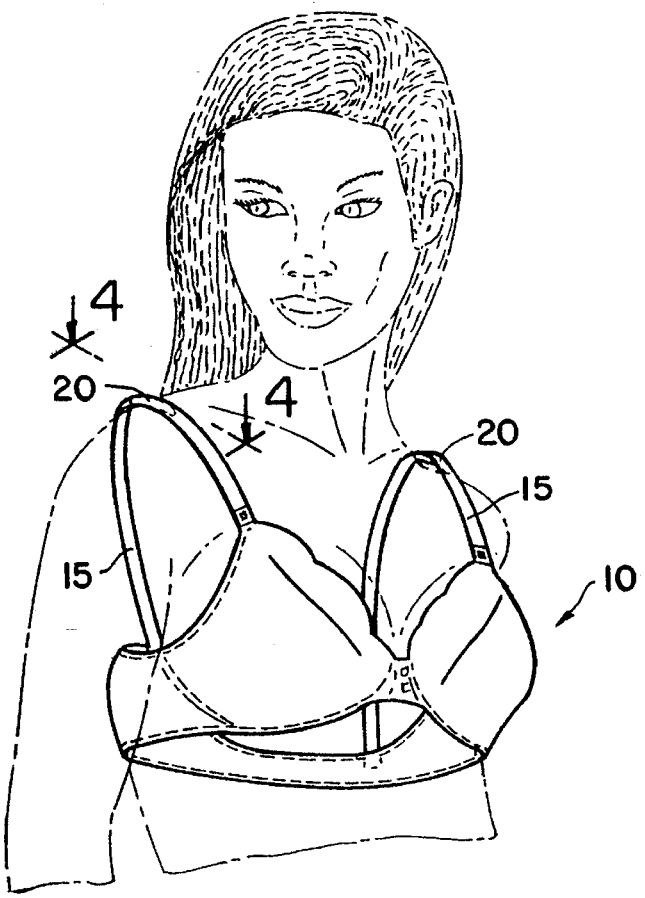
FIG. 1 is a perspective view of a brassiere having a pair of the brassiere straps each incorporating the cushion strap assembly of the present invention.
Figure 2:
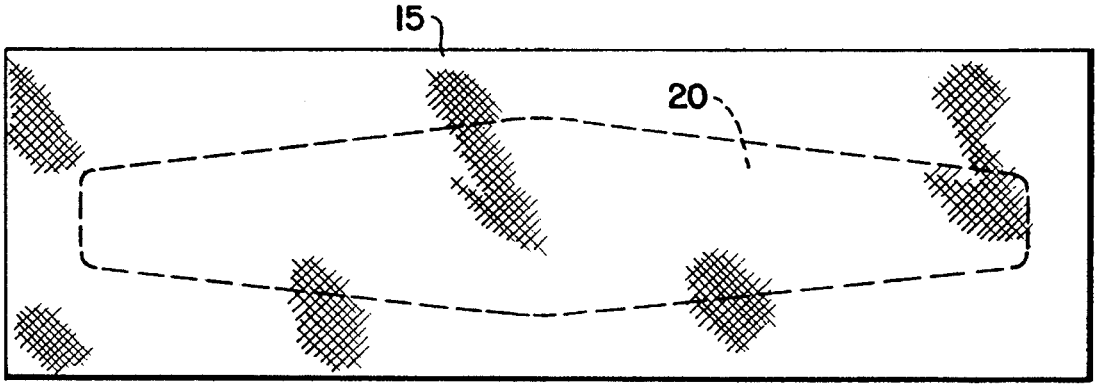
FIG. 2 is a top view of a brassiere strap having the cushion strap assembly of FIG. 1.

Referring to the figures and, in particular, FIG. 1, there is provided a brassiere generally represented by reference numeral 10. The brassiere 10 includes a pair of shoulder straps 15. Each shoulder strap 15 has, as shown more clearly in outline form in FIG. 2, a cushion strap assembly 20 of the present invention.

Figure 3:
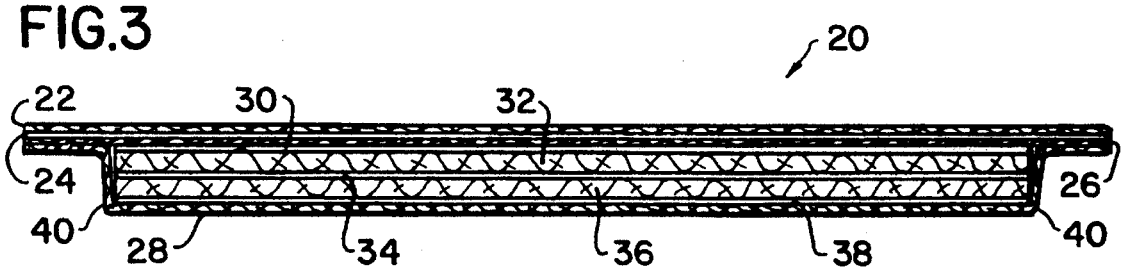
FIG. 3 is a cross-sectional view of the cushion strap assembly of FIG. 1.

Referring to FIG. 3, the cushion strap assembly 20 includes approximately nine layers of material and adhesive. These nine layers can be broken-down into three portions, namely a top cover, a bottom cover, and a cushion filler that is positioned between the top and bottom covers.

The top cover includes an outer or top fabric layer 22, a first adhesive web layer 24 and a base layer 26. The top fabric layer 22 is a decorative layer that is the top of the brassiere strap, namely the part of the brassiere strap away from the shoulder of the brassiere wearer. The top fabric layer 22 is made of one hundred percent polyester. It is believed that nylon or cotton or any other fabric made of synthetic fiber could possibly be used as a top fabric layer 22, instead of one hundred percent polyester. However, one hundred percent polyester fabric is preferred since it holds its shape better and takes heat better than these other materials. In particular, polyester has better shape retention and shape recovery characteristics than these other materials. Also, cotton is more expensive than polyester.

The preferred top fabric layer 22 is a fifty denier, one hundred percent polyester circular knit fabric sold under the name Laguna by Sextet Incorporated. It should be understood that the one hundred percent polyester fabric does not have to be a circular knit fabric. In the most preferred embodiment, the Laguna is a deluster printed Laguna since it is bright and thereby emphasizes the print. The preferred deluster printed Laguna is known as deluster printed Laguna 29-079.

The first adhesive web layer 24 is not merely adhesive, but is a film or web of adhesive. A film or web of adhesive is desired since it will readily migrate into adjacent layers, such as the top fabric layer 22 and the base layer 26, during the laminating process. In the preferred embodiment, the first adhesive web layer 24 is made of any adhesive nylon web that is one hundred percent polyamide adhesive net. It has a fusing temperature range, as measured on a temperature-gradient bar (Kofler) of 200 to 230 degrees Fahrenheit. This material can withstand washing and dry cleaning when heavier amounts of adhesive are used. This adhesive web, as used in each layer of the present cushion strap assembly, is 0.6 ounces per square yard (oz./sq.yd.). The preferred adhesive web layer is Sharnet SH2410-.6 web sold by Applied Extrusion Technologies, Inc. It is believed that the adhesive web or film could be a polyester, polyamide (nylon) or polyurethane, however the nylon material is the least expense.

The base layer 26 is a one hundred percent polyester fabric. One hundred percent polyester fabric, as the base layer 26, has been found to have the desired stability during the lamination process. Basically, it can withstand shrinkage during heating and has a higher melting point than other synthetic fabrics. Thus, no other synthetic fabric, at this time, has been found to have the desired stability during lamination, as one hundred percent polyester.

The preferred base layer 26 is made of plain Laguna. The plain Laguna, like the top fabric layer 22, is made of one hundred percent polyester fabric and, preferably, is a fifty denier, one hundred percent polyester circular knit fabric. This plain Laguna does not, however, have the deluster or print of the top fabric layer 22. The preferred plain Laguna is known as plain Laguna 22-140.

The bottom cover includes a bottom fabric layer 28. The bottom fabric layer 28 forms the outer or bottom part of the strap that contacts the skin of the brassiere wearer. The bottom fabric layer 28, like the top fabric and base layers 22 and 24, is made of one hundred percent polyester. The bottom fabric layer 28 is preferably made of plain Laguna, preferably plain Laguna 22-140.

The cushion filler consists of the first cushion layer 32, the third adhesive web layer 34, and the second cushion layer 36. The third adhesive web layer 34, like the first adhesive web layer 24, is preferably made of Sharnet SH2410-.6 web. Each cushion layer 32 and 36 is made of a one hundred percent polyester fabric that is known as Duplex fabric 22-048, and is sold by Fairlane Incorporated. This Duplex fabric is the subject of U.S. Pat. No. 4,601,940, to A. W. Fischer, which issued on Jul. 22, 1986, and is incorporated herein by reference.

This Duplex fabric is preferred since it has a unique construction that provides both the best performance and profile. Specifically, the yarns in this fabric have been found to stand erect and maintain their resiliency even during compression. For this reason, this fabric is preferred over other fabrics.

The thickness of each layer of this fabric should be such that each layer is not too thick since the yarns in this fabric will have a tendency to lean from their vertical position and, thus, some resiliency will be lost during compression. Conversely, if each layer of this fabric is too thin, it will not have enough fluff. Accordingly, each layer of this Duplex fabric in the present cushion strap assembly should be about 0.120 inches +/−0.025 inches in thickness.

The use of only two layers of Duplex fabric is preferred in the present cushion strap assembly since more than two layers did not perform as well as two layers. Also, more than two layers would result in a thicker and, perhaps, bulky appearance.

It has been found that fiberfill cannot be used as effectively as a cushion layer since fiberfill is not as stable. Also, foam is not desired as a cushion layer since it would decompose during the heating needed in the present process of making the cushion strap assembly. Further, as stated above, foam has poor wear life.

A second adhesive web layer 30 is positioned between the top cover or binder layer and the cushion filler. Specifically, it is positioned between the base layer 26 and the first cushion layer 32 to secure the top cover and cushion filler together during lamination.

It should be understood that in the most preferred method of making the cushion strap assembly, the second adhesive web layer 30 is positioned on the first cushion layer 32 before alignment of the cushion filler and, thus, in that embodiment is part of the cushion filler.

A fourth adhesive web layer 38 is positioned between the cushion filler and the bottom fabric layer 28 to secure them together during lamination. Specifically, the fourth adhesive web layer 38 is positioned between the second cushion layer 36 on a side opposite the third adhesive web layer 34 and the bottom fabric layer 28.

The second and fourth adhesive web layers 30 and 38, like the first and third adhesive web layers 24 and 34, are preferably made of Sharnet SH2410-.6 web. When the components of the cushion assembly are heated during lamination, the adhesive web layers migrate into the adjacent layers to form the laminate.

Thus, the cushion strap assembly includes the following layers in sequential order from the top of the brassiere strap: the top fabric layer 22, the first adhesive web layer 24, the base layer 26, the second adhesive web layer 30, the first cushion layer 32, the third adhesive web layer 34, the second cushion layer 36, the fourth adhesive web layer 38, and the bottom fabric layer 28.

Figure 4:
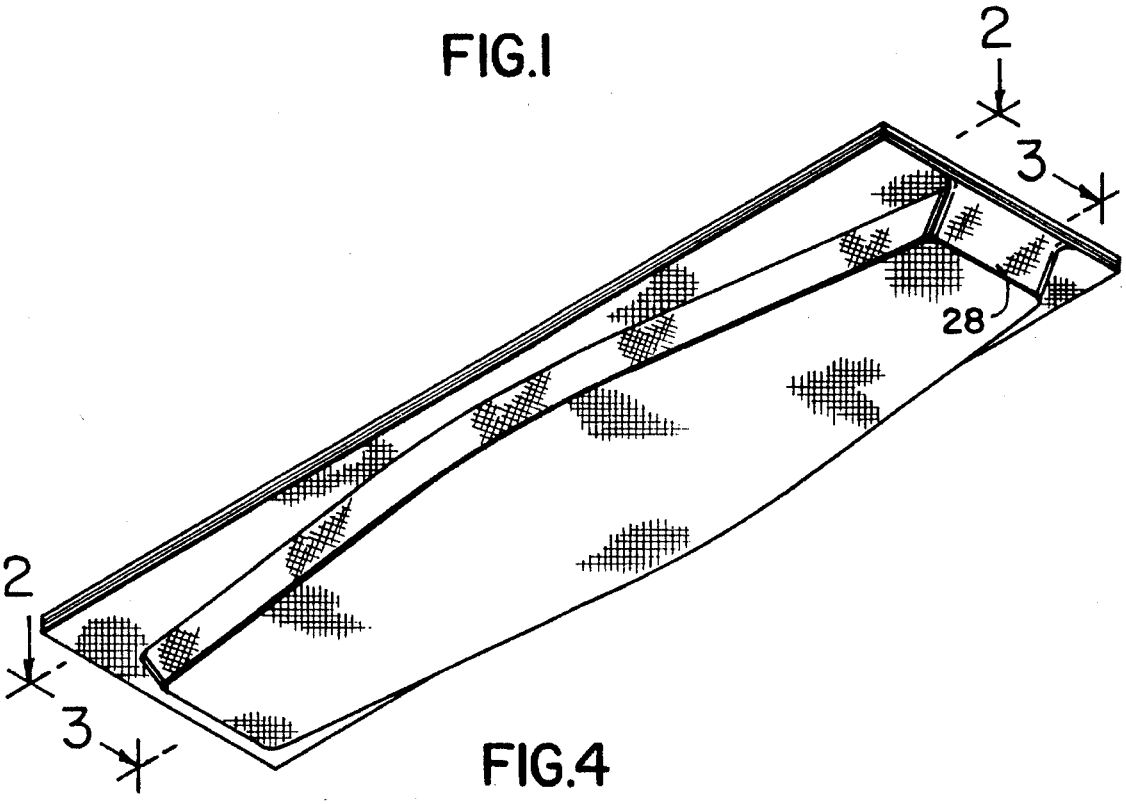
FIG. 4 is a perspective, sectional view taken along lines 4—4 of FIG. 1 illustrating the formed bottom portion of the cushion strap assembly.

The top fabric layer 22, the first adhesive web layer 24 and the base layer 26 form the top cover of the strap, and the bottom fabric layer 28 forms the bottom cover of the strap. These top and bottom covers form an enclosure or enclosed sheath that receives the cushion filler. As shown in FIGS. 3 and 4, the bottom fabric layer 28 forms the depth of the enclosure. As shown in FIG. 3, the cushion filler does not contact the ends of the enclosure, but instead there is a space 40 at each end. Thus, the cushion filler would move within the enclosure if it were not for the second and fourth adhesive web layers 30 and 38 that secure the cushion filler into position between the top and bottom covers. The space 40 provides for some stretching of the cushion filler that occurs during the lamination process, as well as the washing of the shoulder strap. Also, the construction of the cushion filler and the assembly, and the nature of the materials, permits controlled stretching and twisting that normally occurs during washing.

The formed cushion strap assembly provides a pleasing aesthetic appearance of a sleek strap. It has been found through preliminary tests that this appearance remains after repeated washings. This is apparently due to the materials used and the construction of the cushion strap assembly.

A limited wear test was performed on ninety-five women using a brassiere (a new 18 HOUR brassiere by Playtex Apparel, Inc.), but incorporating the present cushion strap assembly. Sixty-three percent of the women stated that they usually get shoulder discomfort, "dig-in" or pain with their usual brassiere. Ninety-six percent stated that the brassiere with this cushion strap assembly relieved that discomfort. Also, more than ninety percent felt that the brassiere straps incorporating this cushion strap assembly were comfortable, while about seven out of ten stated that it was very comfortable.

Further, there were very few women who complained that the brassiere irritated her skin. When prompted, only eight percent stated that it irritated them and specific complaints were noted by three or fewer woman. Only one woman complained about the cushioned strap assembly itself.

Figure 5:
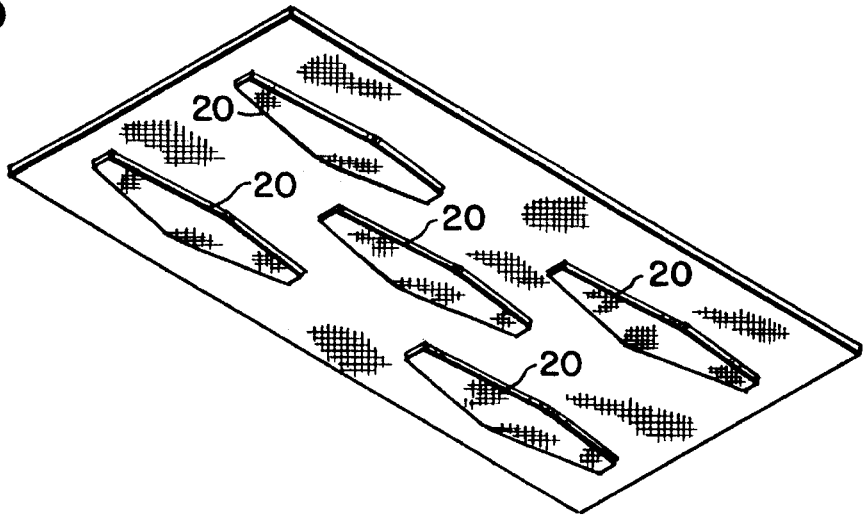
FIG. 5 is a plurality of cushion strap assemblies during the formation process.
Figure 6:
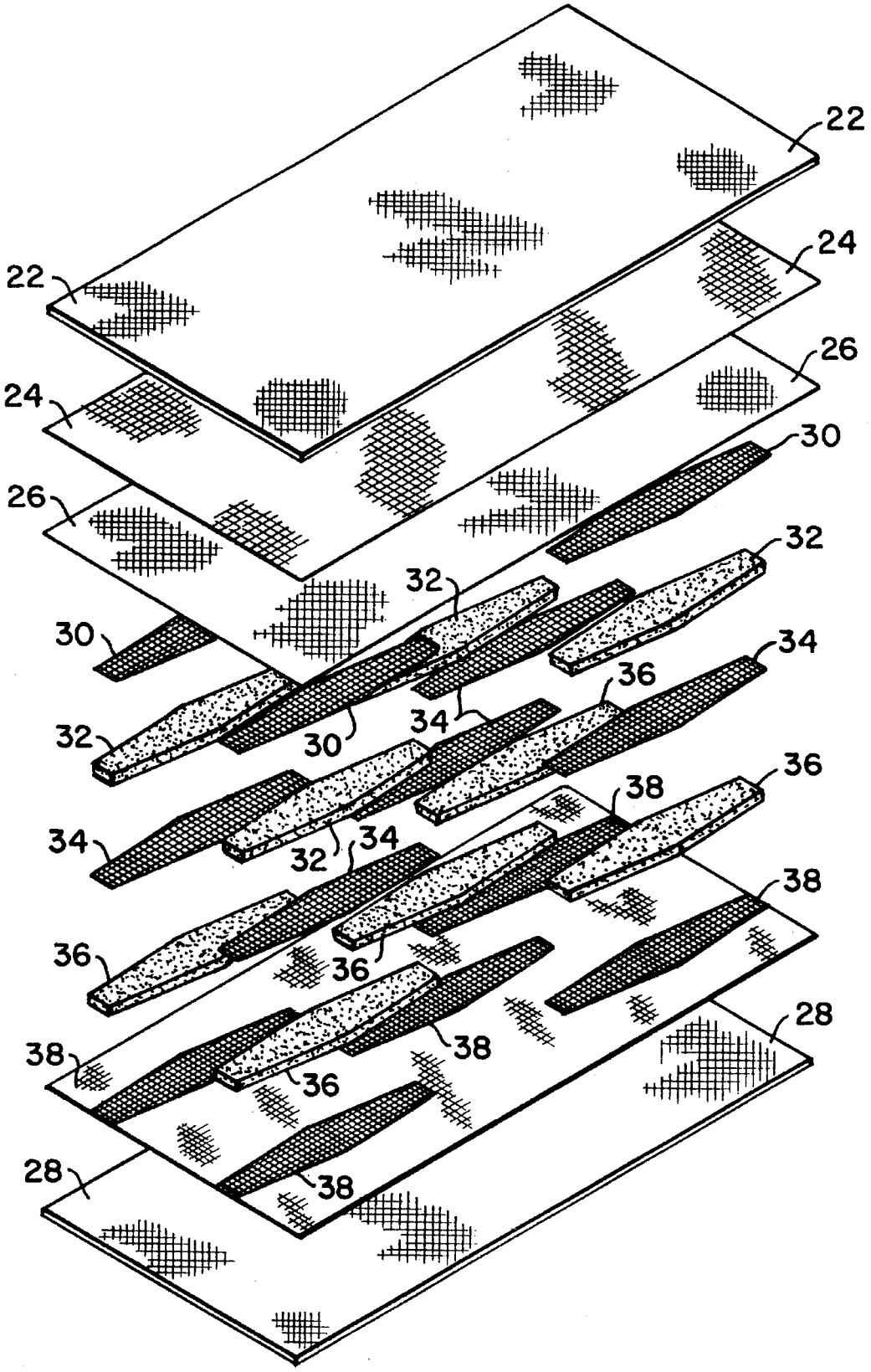
FIG. 6 is an exploded view of the components used to manufacture the plurality of cushion strap assemblies.

Referring to FIGS. 5 and 6, this cushion strap lends itself to the making of several cushion strap assemblies and resultant straps at the same time. First, the top cover is laminated into a binder layer. Specifically, the top fabric layer 22, the first adhesive web layer 24 and the base layer 26 are laminated together to form a binder layer. The components of the cushion filler are then separately laminated together. It should be understood that the cushion filler could be formed after or simultaneously with the formation of the top cover.

The cushion filler is formed by positioning a first side of the third adhesive web layer 34 on one side of the first cushion layer 32, and the second cushion layer 36 on the second side of the third adhesive web layer, and then laminating the components together.

The laminated binder is feed to an alignment station. The laminated cushion filler is positioned with the first cushion layer 32 adjacent the base layer 26 of the binder layer. The second adhesive web layer 30 is positioned therebetween and then the first cushion layer 32 and the base layer 26 are laminated together so that the top cover and cushion filler are laminated together. The fourth adhesive web layer 38 is then applied to the side of the second cushion layer 36 of the cushion filler opposite the third adhesive web layer 34. The bottom fabric layer 28 is applied to the side of the fourth adhesive web layer opposite that of the second cushion layer 36.

The cushion filler, as well as the top and bottom covers, are not compressed other than normal compression associated with lamination. Each component's compression, if any, is the same as that of the other components so that each component is of the same density, thus providing a good profile and appearance.

Figure 7:
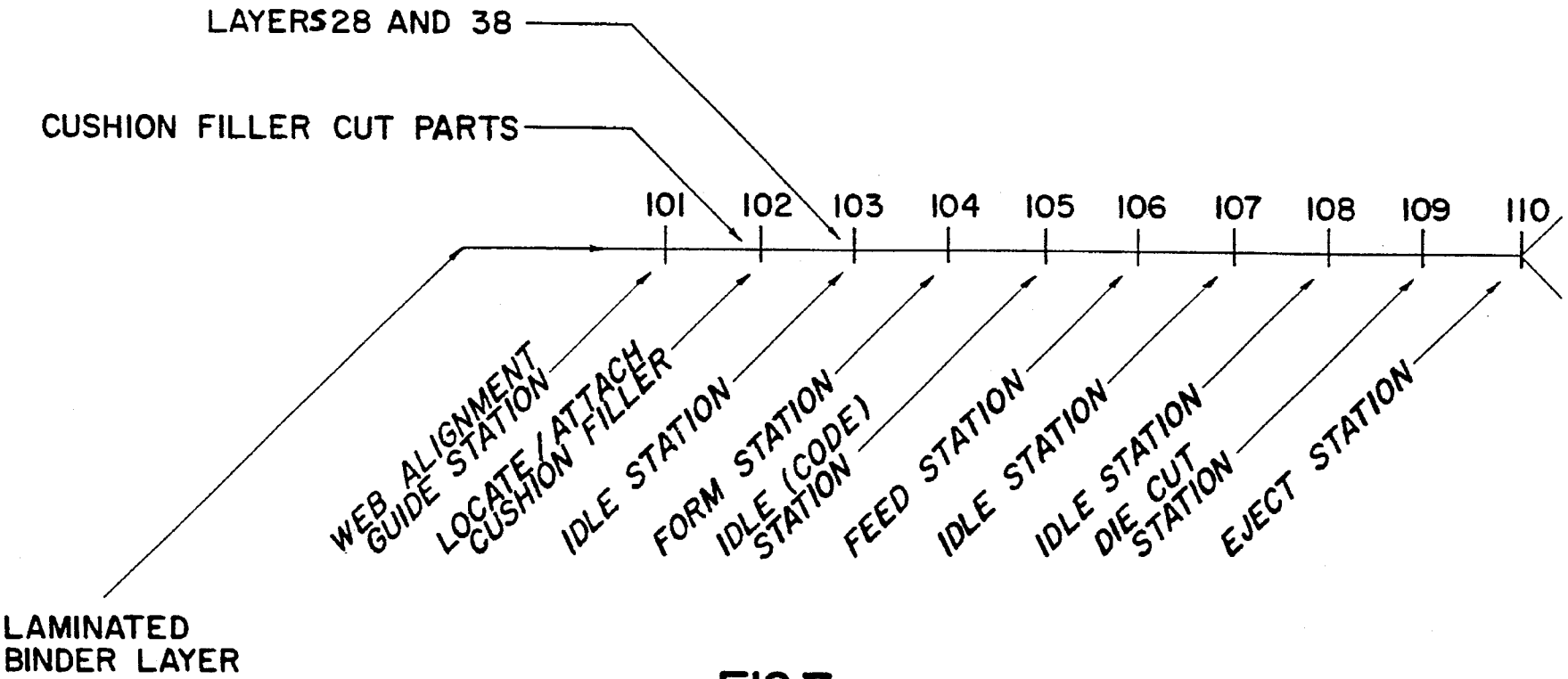
FIG. 7 is a schematic diagram of the operational steps for making the present cushion strap assembly.

The operation or operational steps are schematically outlined in FIG. 7. In particular, the laminated binder layer slit to the proper width will be fed into the machine through the alignment station 101 at which the components of the binder layer will be aligned in proper position for processing. Station 102 will position and accurately align the components of the cushion filler including the second adhesive web layer 30 and apply the base layer 26 of the top cover or binder layer to the cushion filler. At station 103, the fourth adhesive web layer 38 with the bottom fabric layer 28 positioned thereon is placed on the cushion filler and the binder layer.

Station 104 is the cushion assembly forming station at which a temperature controlled lower and an upper forming blocks are heated to a desired temperature and form the cushion strap assembly. The upper block has a cavity therein that is complementary to the cushion filler, while the other mating surfaces of this station are completely flat.

In a preferred operation, the lower block advances against the upper block so that the components of the cushion strap assembly are tightly held in place between the mating surfaces of the blocks and heated to laminate the structure. However, it should be understood that either block or both forming blocks could move during the operation at station 104.

Station 105 is the cool down station, and station 106 is an automatic feed station at which the proper length of material will be feed into the machine and prevents, preferably via clamps, shifting of the materials during the feed return and reset stroke. This station feeds the strap material a preset distance at each machine cycle to maintain the component alignment between the form station 104 and the cutting station 109.

Stations 107 and 108 are simply idle stations between the feed station 105 and cut station 109 to adjust, if necessary, the sequencing of the operation. In the preferred operation, station 109 has the die cut machine that is a hydraulically operated lower cutting ram and a fixed top cutting die. The lower cutting ram will operate upwards against the top die to cut the strap part away from the scrap. However, it should be understood that the lower cutting ram and the top cutting die can both move or the top cutting die can move while the lower ram is maintained fixed.

Station 110 is an eject station at which the cut straps and waste will be sent to the appropriate locations.

Having thus described the present invention with particular references to the preferred forms thereof, it will be obvious that various changes and modifications may be made therein without departing from the spirit and scope of the present invention as defined by the appended claims.

Wherefore, We (I) claim:

1. A laminated cushion strap assembly comprising:

cover means that includes a top fabric, a first adhesive web layer positioned on one side of the top fabric and a base layer positioned on the first adhesive web layer on a side opposite that of the top fabric;

a bottom fabric that forms with the cover means an enclosure;

a cushion filler adapted to be completely enclosed within the enclosure, the cushion filler comprising a first cushion means and second cushion means secured together by an adhesive web layer, wherein the adhesive web layer is a third adhesive web layer; and means for securing during lamination the cover means to the cushion filler, and the cushion filler to the bottom fabric, wherein the securing means includes a second adhesive web layer positioned between the base layer and the first cushion means to secure the cushion filler to the cover means, and a fourth adhesive web layer positioned on the second cushion layer to secure the bottom fabric to the cushion filler, wherein the components of the cushion strap assembly are laminated together completely heat and adhesive.

2. The laminated cushion strap assembly according to claim 1, wherein the assembly is a brassiere shoulder strap.

3. A laminated cushion strap assembly comprising:

a top cover that includes a top fabric layer, a first adhesive web layer positioned on one side of the top fabric layer and a base layer positioned on the first adhesive web layer on a side opposite that of the top fabric layer;

a bottom cover that forms with the top cover an enclosure;

a cushion filler adapted to be completely enclosed within the enclosure, the cushion filler comprising a first cushion layer, a third adhesive web layer positioned on the first cushion layer, and a second cushion layer positioned on the third adhesive web layer on a side opposite that of the first cushion layer; and means for securing during lamination the top cover to the cushion filler, and the cushion filler to the bottom cover, wherein the securing means includes a second adhesive web layer positioned between the base layer and the first cushion means to secure the cushion filler to the top cover, wherein the components of the cushion strap assembly are laminated together completely by heat and adhesive.

4. The laminated cushion strap assembly according to claim 3, wherein the securing means includes a fourth adhesive web layer positioned on the second cushion layer on a side opposite that of the third adhesive layer to secure the bottom cover to the cushion filler.

5. The laminated cushion strap assembly according to claim 4, wherein the base layer is a stabilizer layer made of one hundred percent polyester fabric.

6. The laminated cushion strap assembly according to claim 4, wherein the first cushion layer and the second cushion layer each is made of one hundred percent polyester fabric.

7. The laminated cushion strap assembly according to claim 5, wherein the top fabric layer is fifty denier, circular knit fabric.

8. The laminated cushion strap assembly according to claim 3, wherein the first and second cushion layers each is 0.120 inches +/−0.025 inches in thickness.

9. The laminated cushion strap assembly according to claim 3, wherein the bottom cover is a bottom fabric layer.

10. The laminated cushion strap assembly according to claim 9, wherein the top fabric layer and the bottom fabric layer each is made of one hundred percent polyester fabric.

11. The laminated cushion strap assembly according to claim 3, wherein the top fabric layer is made of a deluster printed, one hundred percent polyester fabric.

12. The laminated cushion strap assembly according to claim 3, wherein the assembly is a brassiere shoulder strap.

13. The laminated cushion strap assembly according to claim 4, wherein the first, second, third and fourth adhesive web layers each is made of a nylon web.

14. The laminated cushion strap assembly according to claim 13, wherein the nylon web is one hundred percent polyamide.

15. A laminated cushion strap assembly comprising:

a top cover that includes a top fabric layer, a first adhesive web layer positioned on one side of the top fabric layer and a base layer positioned on the first adhesive web layer on a side opposite that of the top fabric layer;

a bottom cover that forms with the top cover an enclosure;

a cushion filler adapted to be completely enclosed within the enclosure, the cushion filler comprising a first cushion layer, a third adhesive web layer positioned on the first cushion layer, a second cushion layer positioned on the third adhesive web layer on a side opposite that of the first cushion layer, a second adhesive web layer positioned on the first cushion layer, on a side opposite the third adhesive layer, to secure the cushion filler to the top cover which second adhesive web layer is part of the securing means; and means for securing during lamination the top cover to the cushion filler, and the cushion filler to the bottom cover, wherein the components of the cushion strap assembly are laminated together completely by heat and adhesive.

16. A laminated cushion strap assembly comprising:

a top cover that includes a top fabric layer, a first adhesive web layer positioned on one side of the top fabric layer and a base layer positioned on the first adhesive web layer on a side opposite that of the top fabric layer;

a bottom cover that forms with the top cover an enclosure;

a cushion filler adapted to be completely enclosed within the enclosure, the cushion filler comprising a first cushion layer, a third adhesive web layer positioned on the first cushion layer, and a second cushion layer positioned on the third adhesive web layer on a side opposite that of the first cushion layer; and means for securing during lamination the top cover to the cushion filler, and the cushion filler to the bottom cover, wherein the securing means includes a fourth adhesive web layer positioned on the second cushion layer on a side opposite that of the third adhesive layer to secure the bottom fabric to the cushion filler, wherein the components of the cushion strap assembly are laminated together completely by heat and adhesive.

17. A cushion strap assembly comprising:

a top fabric layer having a first side and a second side;

a first adhesive web layer positioned on the second side of the top fabric layer;

a base layer positioned on the first adhesive layer on a side opposite that of the top fabric layer;

a second adhesive web layer positioned on the base layer on a side opposite the first adhesive web layer;

a first cushion layer positioned on the second adhesive web layer on a side opposite that of the base layer;

a third adhesive web layer positioned on the first cushion layer on a side opposite that of the second adhesive layer;

a second cushion layer positioned on the third adhesive layer on a side opposite that of the first cushion layer;

a fourth adhesive web layer positioned on the second cushion layer on a side opposite that of the third adhesive web layer; and a bottom fabric layer positioned on the fourth adhesive web layer on a side opposite that of the second cushion layer.

18. The cushion strap assembly according to claim 17, wherein the assembly is a brassiere shoulder strap.

19. A method of making a cushion strap assembly comprising:

positioning a top cover having a top fabric, positioning a first adhesive web layer on one side of the top fabric and positioning a base layer on the first adhesive web layer on a side opposite that of the top fabric, laminating together the top fabric, the first adhesive web layer and the base layer to form a binder layer;

positioning a cushion filler comprising positioning a second adhesive web layer, positioning a first cushion layer on a side of the second adhesive web layer, positioning a third adhesive web layer on the first cushion layer on a side opposite the second adhesive web layer, and positioning a second cushion layer on the third adhesive web layer on a side opposite that of the first cushion layer;

positioning, on a side opposite that of the third adhesive layer, a fourth adhesive web layer on the second cushion layer of the cushion filler, and positioning a bottom fabric layer on the fourth adhesive web layer on a side opposite that of the second cushion layer;

positioning the second adhesive web layer on the base layer on a side opposite the first adhesive web layer; and laminating together the binder layer, the cushion filler and the bottom fabric layer to form the cushion strap assembly.

20. The method according to claim 19, wherein laminating together the binder layer, the cushion filler and the bottom fabric layer includes positioning the cushion filler, the binder layer and the bottom fabric layer between a lower block and an upper block, and advancing the lower block against the upper block so that the binder layer, the cushion filler and the bottom fabric layer are tightly held in place therebetween.

21. The method according to claim 20, further comprising heating the tightly held binder layer, cushion filler and bottom fabric layer.

22. A laminated cushion strap assembly comprising:

cover means that includes a top fabric, a first adhesive web layer positioned on one side of the top fabric and a base layer positioned on the first adhesive web layer on a side opposite that of the top fabric;

a bottom fabric that forms with the cover means an enclosure;

a cushion filler adapted to be positioned in the enclosure, the cushion filler comprising a first cushion means and second cushion means secured together by a third adhesive web layer; and means for securing during lamination the cover means to the cushion filler and the cushion filler to the bottom fabric, wherein said means for securing includes a second adhesive web layer positioned on the base layer on a side opposite the first adhesive web layer.

23. The laminated cushion strap assembly according to claim 22, wherein the securing means includes a fourth adhesive web layer positioned on the second cushion layer to secure the bottom fabric to the cushion filler.

24. The laminated cushion strap assembly according to claim 22, wherein the assembly is a brassiere shoulder strap.

* * * * *